US007934791B2

(12) United States Patent
Masuyama et al.

(10) Patent No.: US 7,934,791 B2
(45) Date of Patent: May 3, 2011

(54) PRINTING APPARATUS, INK MIST COLLECTING METHOD, AND PRINTING METHOD

(75) Inventors: Atsuhiko Masuyama, Tokyo (JP); Jiro Moriyama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 992 days.

(21) Appl. No.: 11/721,499

(22) PCT Filed: Dec. 21, 2005

(86) PCT No.: PCT/JP2005/023987

§ 371 (c)(1),
(2), (4) Date: Jun. 12, 2007

(87) PCT Pub. No.: WO2006/068281

PCT Pub. Date: Jun. 29, 2006

(65) Prior Publication Data

US 2008/0018707 A1 Jan. 24, 2008

(30) Foreign Application Priority Data

Dec. 22, 2004 (JP) ..... 2004-371883

(51) Int. Cl.
*B41J 2/165* (2006.01)

(52) U.S. Cl. ..... 347/34; 347/22; 347/55; 347/84; 347/85; 347/89; 347/16; 347/83; 347/29; 347/30

(58) Field of Classification Search ..... 347/16, 347/22, 29–30, 34, 55, 83–85, 89
See application file for complete search history.

(56) References Cited

U.S. PATENT DOCUMENTS

| | | | | |
|---|---|---|---|---|
| 3,981,020 | A * | 9/1976 | Takano et al. | 347/34 |
| 4,024,548 | A * | 5/1977 | Alonso et al. | 347/34 |
| 4,478,510 | A | 10/1984 | Fuji et al. | |
| 4,668,959 | A | 5/1987 | Jochimsen et al. | 347/34 |
| 4,736,212 | A * | 4/1988 | Oda et al. | 347/55 |
| 4,788,564 | A * | 11/1988 | Ochiai | 347/55 |
| 4,794,463 | A * | 12/1988 | Tamura et al. | 358/296 |
| 4,959,660 | A * | 9/1990 | Suzuki et al. | 347/34 |
| 5,646,659 | A | 7/1997 | Moriyama et al. | |
| 5,838,349 | A * | 11/1998 | Choi et al. | 347/55 |
| 5,896,148 | A | 4/1999 | Fukushima et al. | |
| 6,036,302 | A | 3/2000 | Hotomi | |
| 6,435,648 | B1 * | 8/2002 | Murakami et al. | 347/29 |
| 6,554,380 | B2 | 4/2003 | Moriyama et al. | 347/7 |
| 6,802,591 | B2 | 10/2004 | Takahashi | |
| 7,014,292 | B2 | 3/2006 | Yazawa et al. | |
| 7,156,515 | B2 | 1/2007 | Iwata | 347/102 |

(Continued)

FOREIGN PATENT DOCUMENTS

CN 86108108 A 12/1987

(Continued)

*Primary Examiner* — Ryan Lepisto
*Assistant Examiner* — Guy G Anderson
(74) *Attorney, Agent, or Firm* — Fitzpatrick, Cella, Harper & Scinto

(57) ABSTRACT

There are provided a printing apparatus and printing method capable of collecting unwanted ink mist and achieving high-quality printing by fine ink droplets. According to the method, the charges of a printing medium are removed prior to printing, and an ink mist collecting unit having an electrode of a positive polarity is employed. Floating ink mist is collected such that ink mist generated from discharged ink droplets and negatively charged is moved toward the ink mist collecting unit by the electrostatic force.

10 Claims, 11 Drawing Sheets

U.S. PATENT DOCUMENTS

| | | | | |
|---|---|---|---|---|
| 7,410,238 | B2 * | 8/2008 | Morita | 347/34 |
| 7,469,999 | B2 * | 12/2008 | Kadomatsu et al. | 347/55 |
| 7,494,200 | B2 | 2/2009 | Chikuma et al. | 347/9 |
| 7,591,551 | B2 * | 9/2009 | Imoto et al. | 347/104 |
| 7,735,946 | B2 | 6/2010 | Tanaka et al. | 347/8 |
| 7,832,841 | B2 * | 11/2010 | Moriyama et al. | 347/55 |
| 2002/0033865 | A1 | 3/2002 | Ishinaga et al. | |
| 2004/0027412 | A1 | 2/2004 | Takahashi et al. | |
| 2004/0061738 | A1 | 4/2004 | Unosawa | |
| 2006/0092214 | A1 | 5/2006 | Yazawa et al. | |
| 2008/0012924 | A1 | 1/2008 | Moriyama et al. | 347/55 |
| 2008/0143780 | A1 | 6/2008 | Sakamoto et al. | 347/32 |

FOREIGN PATENT DOCUMENTS

| | | |
|---|---|---|
| CN | 1498685 A | 5/2004 |
| EP | 0 473 178 | 3/1992 |
| EP | 0 473 179 | 3/1992 |
| EP | 0 747 220 | 12/1996 |
| EP | 0 795 414 | 9/1997 |
| EP | 0 832 742 | 4/1998 |
| EP | 1 284 197 | 2/2003 |
| JP | 4-083645 | 3/1992 |
| JP | 5-008392 | 1/1993 |
| JP | 5-104724 | 4/1993 |
| JP | 5-124187 | 5/1993 |
| JP | 7-237296 | 9/1995 |
| JP | 8-187842 | 7/1996 |
| JP | 2002-211005 | 7/2002 |
| JP | 2003-014773 | 1/2003 |
| JP | 2003-305840 | 10/2003 |
| JP | 2004-202867 | 7/2004 |
| WO | WO 95/11807 | 5/1995 |
| WO | WO 2006/068290 | 6/2006 |

* cited by examiner

PRINTING APPARATUS, INK MIST COLLECTING METHOD, AND PRINTING METHOD

TECHNICAL FIELD

This invention relates to a printing apparatus, ink mist collecting method, and printing method, and more particularly to a printing apparatus, ink mist collecting method, and printing method using an inkjet printhead which prints by, e.g., discharging fine ink droplets onto a printing medium.

BACKGROUND ART

An inkjet printing apparatus forms an image by fixing small ink droplets serving as a coloring material onto the surface of a printing medium. Recently, printing is done on a printing medium by using not only four conventional color inks including cyan (C), magenta (M), and yellow (Y) color inks and black (Bk) ink, but also low-density inks of similar colors (e.g., light magenta and light cyan), and orange, blue, green, and skin color inks.

The volume of one ink droplet used in the inkjet printing apparatus decreases to 1.0 pl (picoliter) in order to meet recent demands for higher image quality.

An ink droplet 1.0 pl in volume is regarded as mist, and it becomes difficult to control ink droplets in such a small volume one by one.

From the viewpoint of high printing quality, it is desired to attach droplets of, e.g., 1.0 pl or less onto desired positions on a printing medium at a precision of micron order. However, it is difficult to obtain the desired precision under the influence of a peripheral air flow. Immediately after discharging ink, fine ink droplets called "satellites" which are produced when originally one ink droplet is broken into a plurality of ink droplets may attach to unintended positions or float in space.

For this reason, it is difficult to accurately attach all droplets to desired printing positions.

If the above-mentioned satellites or ink droplets bounded back from the surface of a printing medium float in the air to accumulate fine ink droplets, such fine ink droplets contaminate the interior of the printing apparatus and/or degrade the movable characteristic of the movable portion of the printing apparatus. In addition, the fine ink droplets cause various sensors to malfunction. Further, aggregated floating mist during printing attaches to the upper and lower surfaces of a printing medium, or mist left in the apparatus attaches to the upper and lower surfaces of the next printing medium subjected to printing, thereby contaminating the printing medium.

In order to solve this problem, there has conventionally been proposed a method of charging ink droplets and controlling them in an inkjet printing apparatus.

For example, in Japanese Patent Publication Laid-Open No. 5-008392, the electric field is controlled to be applied between a printhead and a printing medium and to be stopped during ink discharge. This control prevents positive or negative charging of ink droplets by the electric field and a failure of ink charged to either polarity in attaching to a printing medium.

Japanese Patent Publication Laid-Open No. 5-104724 proposes a method of injecting charges into ink in the printhead and attracting ink toward a printing medium.

Japanese Patent Publication Laid-Open No. 5-124187 proposes a method of controlling the electric field and discriminately controlling main droplets and subsequent satellite droplets.

Japanese Patent Publication Laid-Open No. 2002-211005 proposes a method of positively or negatively charging each of plural types of inks and capturing mist by an electrode.

Japanese Patent Publication Laid-Open No. 2003-014773 proposes a method of charging ink by an ionizer and collecting ink droplets.

The techniques disclosed in these prior arts have the following problems.

In order to implement high-speed printing, control of the electric field according to Japanese Patent Publication Laid-Open No. 5-008392 must be performed at a very high frequency. It is practically difficult to perform such control, or high-speed printing is limited. Electromagnetic waves are generated by high-frequency control of the electric field and act as a noise source, degrading the reliability and safety of the printing apparatus.

In the method according to Japanese Patent Publication Laid-Open No. 5-104724, polarization occurs because, when a fine droplet is discharged from the printhead, it elongates in the discharge direction and is broken into a plurality of droplets. Upon polarization, a fine droplet is charged positively or negatively. A fine droplet may be attracted to a printing medium or repulsed by the printing medium. It is difficult to control a fine droplet.

In the method according to Japanese Patent Publication Laid-Open No. 5-124187, polarization as described above occurs, and separation of satellite droplets slightly changes one by one. It is, therefore, difficult to accurately control a satellite droplet.

In the method according to Japanese Patent Publication Laid-Open No. 2002-211005, the structure of the printing apparatus becomes complicated because a charging mechanism for each type of ink must be arranged.

The method according to Japanese Patent Publication Laid-Open No. 2003-014773 does not intend to force ink droplets to move toward a printing medium, and poses a problem in achieving high-quality printing.

DISCLOSURE OF INVENTION

Accordingly, the present invention is conceived as a response to the above-described disadvantages of the conventional art.

For example, a printing apparatus, ink mist collecting method, and printing method according to the present invention are capable of controlling the traveling direction of fine ink droplets by electrostatic force, collecting unwanted floating ink droplets (ink mist) or attaching ink mist onto desired positions on a printing medium, and thereby achieving high-quality printing.

According to one aspect of the present invention, preferably, there is provided a printing apparatus which prints by discharging an ink droplet from a printhead onto a printing medium, comprising: charge removing means for removing charges from the printing medium before printing; printing means for printing by discharging ink from the printhead onto the printing medium; and collecting means for collecting, by electrostatic force, ink mist which is discharged from the printhead for printing by said printing means and floats without being used for printing.

The collecting means desirably comprises a first electrode having a polarity opposite to a polarity of the ink mist, and a reservoir unit which stores ink from ink mist collected by the electrode and contains an absorber.

The collecting means is desirably arranged near an end of a printing area of the printing medium.

The printing apparatus desirably further comprises a fan which moves the ink mist toward the collecting means via the printing area on a side opposite to a position where the collecting means is arranged.

Alternatively, the printing apparatus may further comprise a fan, which sends air of the printing area to a position where the collecting means is arranged, provided between the printing area and the position where the collecting means is arranged.

Alternatively, the printing apparatus may further comprise a second electrode on a side on which the second electrode faces an ink discharge surface of the printhead via the printing medium in the printing area for the printing medium by the printhead, and a surface of the printing medium that faces the ink discharge surface of the printhead may be charged by applying a voltage to the second electrode.

In this case, the ink mist is negatively charged, and a positive voltage is applied to the first electrode and the second electrode.

Furthermore, the printing apparatus may further comprise scanning means for reciprocating the printhead, a platen which supports the printing medium along a scanning direction of the scanning means, and an ink absorber which absorbs ink discharged from the printhead along the platen. The ink absorber desirably has a third electrode which attracts the ink mist by electrostatic force.

In a case where a distance between the ink discharge surface of the printhead and the printing medium is short and an electric field is generated, a polarity of the second electrode is desirably controlled in synchronism with movement of the printhead and an ink discharge cycle, and reversed in accordance with a positional relationship with an ink discharge nozzle of the printhead.

According to another aspect of the present invention, preferably, there is provided an ink mist collecting method for a printing apparatus which prints by discharging an ink droplet from a printhead onto a printing medium, comprising: a charge removing step of removing charges from the printing medium before printing; a printing step of printing by discharging ink from the printhead onto the printing medium from which charges have been removed at the charge removing step; and a collecting step of collecting, by electrostatic force, ink mist which is discharged from the printhead for printing at the printing step, and floats without being used for printing.

According to still another aspect of the present invention, preferably, there is provided a printing method comprising: a printing step of printing by discharging ink from a printhead onto a printing medium; a charging step of charging the printing medium by electrostatic induction; and a guiding step of guiding, toward the printing medium by electrostatic force, satellite ink which is separated from an ink droplet discharged from the printhead for printing at the printing step and charged, wherein a polarity of a surface of the printing medium and a polarity of the satellite ink are opposite to each other.

The invention is particularly advantageous since charged ink mist which is generated upon discharge of ink droplets is efficiently attracted and collected by electrostatic force, and the amount of ink mist which floats and attaches to unintended portions in the apparatus decreases.

Hence, the present invention can prevent: (1) contamination of the interior of the printing apparatus by attached ink mist; (2) degradation of the movable characteristic by ink mist which attaches to the movable portion of the printing apparatus, e.g., the movable portion of the carriage; (3) a malfunction of a sensor by ink mist which attaches to the sensor; (4) contamination of the exterior of the apparatus by aggregated ink which leaks from the printing apparatus; and (5) contamination of the next printing medium by attached ink mist.

According to another invention, the surface of a printing medium is so charged as to have a polarity opposite to that of charged satellite ink which is separated from an ink droplet discharged from the printhead for printing. Satellite ink can be attracted to the printing medium and used for printing. Thus, satellite ink can be actively used for printing. Since satellite ink does not float to contaminate a printing medium, high-quality printing can be achieved.

Other features and advantages of the present invention will be apparent from the following description taken in conjunction with the accompanying drawings, in which like reference characters designate the same or similar parts throughout the figures thereof.

BRIEF DESCRIPTION OF DRAWINGS

The accompanying drawings, which are incorporated in and constitute a part of the specification, illustrate embodiments of the invention and, together with the description, serve to explain the principles of the invention.

BEST MODE FOR CARRYING OUT THE INVENTION

Preferred embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Furthermore, unless otherwise stated, the term "nozzle" generally means a set of a discharge orifice, a liquid channel connected to the orifice and an element to generate energy utilized for ink discharge.

<Description of Inkjet Printing Apparatus (FIGS. 1 to 2)>

Figure 1:
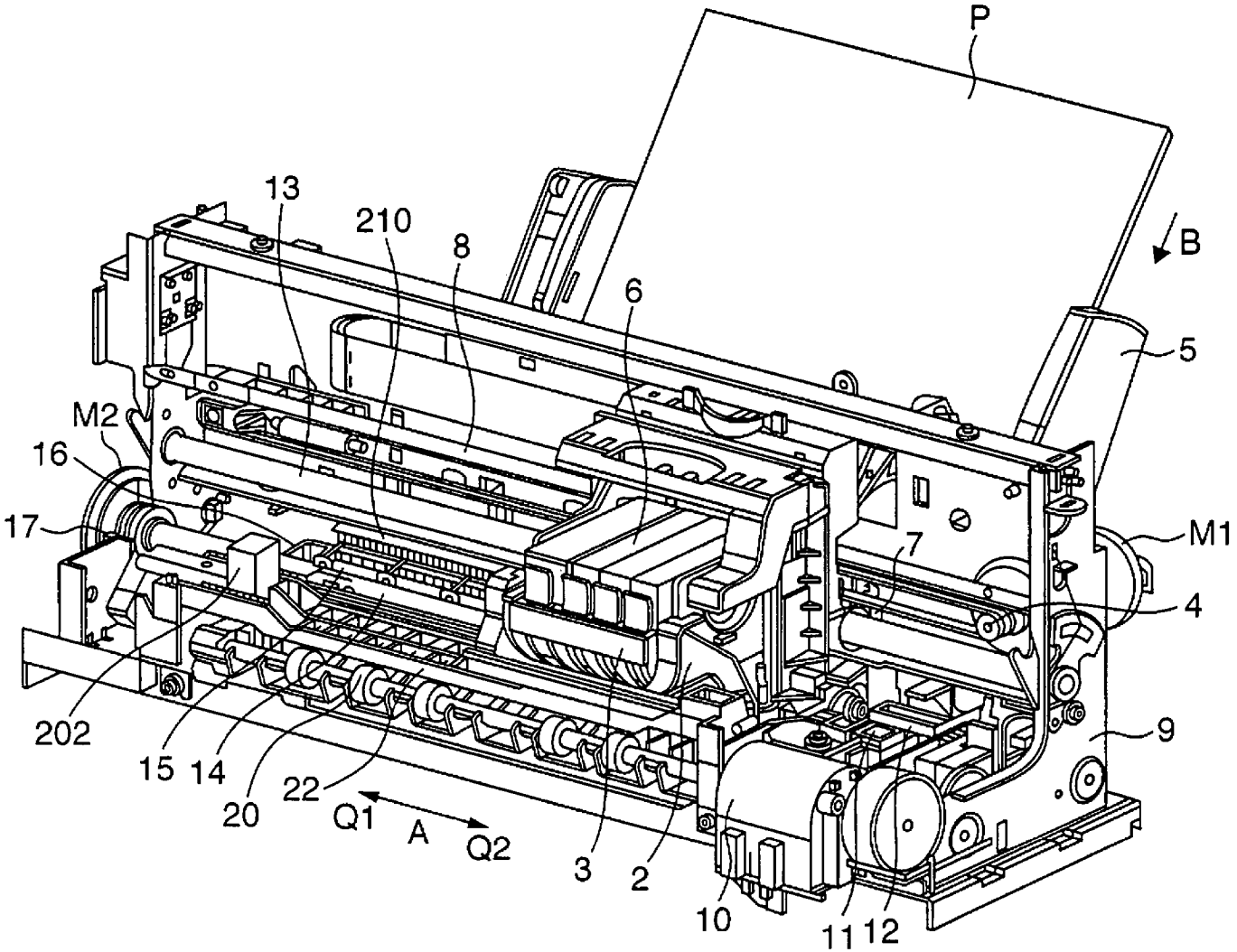
FIG. 1 is a perspective view showing the configuration of an inkjet printing apparatus as a typical embodiment of the present invention.

FIG. 1 is an outer perspective view showing the schematic configuration of an inkjet printing apparatus as a typical embodiment of the present invention.

As shown in FIG. 1, the inkjet printing apparatus (to be referred to as a printing apparatus hereinafter) has a printhead 3 which prints by discharging ink according to the inkjet method. A driving force generated by a carriage motor M1 is transmitted from a transmission mechanism 4 to a carriage 2, and the carriage 2 reciprocates in a direction indicated by an arrow A (in FIG. 1, Q1 represents the leftward direction, and Q2 represents the rightward direction). Upon printing, a printing medium P such as a printing sheet is fed via a sheet feed mechanism 5, and conveyed to a printing position. At the printing position, the printhead 3 discharges ink from downward orifices in FIG. 1 to the printing medium P to print.

In order to maintain a good state of the printhead 3, the carriage 2 is moved to the position of a recovery device 10, and a discharge recovery process for the printhead 3 is performed intermittently.

The carriage 2 of a printing apparatus 1 has not only the printhead 3, but also an ink cartridge 6 which stores ink to be supplied to the printhead 3. The ink cartridge 6 is detachable from the carriage 2.

The printing apparatus 1 shown in FIG. 1 can print in color. For this purpose, the carriage 2 holds four ink cartridges which respectively store magenta (M), cyan (C), yellow (Y), and black (Bk) inks. These four ink cartridges are independently detachable.

The carriage 2 and printhead 3 can achieve and maintain a predetermined electrical connection by properly bringing their contact surfaces into contact with each other. The printhead 3 selectively discharges ink from a plurality of orifices and prints by applying energy in accordance with the printing signal. In particular, the printhead 3 according to this embodiment employs an inkjet method of discharging ink by using thermal energy. For this purpose, the printhead 3 comprises an electrothermal transducer for generating thermal energy, and electric energy applied to the electrothermal transducer is converted into thermal energy. Ink is discharged from orifices by using a change in pressure upon growth and shrinkage of bubbles created by film boiling generated by applying the thermal energy to ink. The electrothermal transducer is arranged in correspondence with each orifice, and ink is discharged from a corresponding orifice by applying a pulse voltage to a corresponding electrothermal transducer in accordance with the printing signal.

As shown in FIG. 1, the carriage 2 is coupled to part of a driving belt 7 of the transmission mechanism 4 which transmits the driving force of the carriage motor M1. The carriage 2 is slidably guided and supported along a guide shaft 13 in the direction indicated by the arrow A. The carriage 2 reciprocates along the guide shaft 13 by normal rotation and reverse rotation of the carriage motor M1. A scale 8 used for indicating the absolute position of the carriage 2 is arranged along the moving direction (direction indicated by the arrow A) of the carriage 2. In this embodiment, the scale 8 is prepared by printing black bars (slits) on a transparent PET film at a necessary pitch. One end of the scale 8 is fixed to a chassis 9, and its other end is supported by a leaf spring (not shown). The carriage 2 comprises an encoder (not shown) for reading the slits of the scale 8.

The printing apparatus has a platen (not shown) facing the orifice surface of the printhead 3, which has orifices (not shown). The carriage 2 holding the printhead 3 reciprocates by the driving force of the carriage motor M1. At the same time, a printing signal is supplied to the printhead 3 to discharge ink and print on the entire width of the printing medium P conveyed onto the platen.

In FIG. 1, reference numeral 14 denotes a conveyance roller which is driven by a conveyance motor M2 in order to convey the printing medium P; 15, a pinch roller which makes the printing medium P contact with the convey roller 14 by a spring (not shown); 16, a pinch roller holder which rotatably supports the pinch roller 15; and 17, a conveyance roller gear which is fixed to one end of the conveyance roller 14. The conveyance roller 14 is driven by rotation of the conveyance motor M2 that is transmitted to the conveyance roller gear 17 via an intermediate gear (not shown).

Reference numeral 20 denotes a discharge roller which discharges the printing medium P bearing an image formed by the printhead 3 outside the printing apparatus. The discharge roller 20 is driven by transmitting rotation of the conveyance motor M2. The discharge roller 20 contacts with the printing medium P by a spur roller (not shown) which presses it by a spring (not shown). Reference numeral 22 denotes a spur holder which rotatably supports the spur roller.

As shown in FIG. 1, in the printing apparatus, the recovery device 10 which recovers the printhead 3 from a discharge failure is arranged at a desired position (e.g., a position corresponding to the home position) outside the reciprocation range (printing area) for printing operation of the carriage 2 holding the printhead 3.

The recovery device 10 comprises a capping mechanism 11 which caps the orifice surface of the printhead 3, and a wiping mechanism 12 which cleans the orifice surface of the printhead 3. The recovery device 10 uses a suction means (suction pump or the like) within the recovery device to forcibly discharge ink from orifices in synchronism with capping the orifice surface by the capping mechanism 11. Accordingly, the recovery device 10 achieves a discharge recovery process of removing ink with a high viscosity or bubbles in the ink channel of the printhead 3.

In non-printing operation or the like, the orifice surface of the printhead 3 is capped by the capping mechanism 11 to protect the printhead 3 and prevent evaporation and drying of ink. The wiping mechanism 12 is arranged near the capping mechanism 11, and wipes ink droplets attached to the orifice surface of the printhead 3.

The capping mechanism 11 and wiping mechanism 12 can maintain a normal ink discharge state of the printhead 3.

Figure 2:
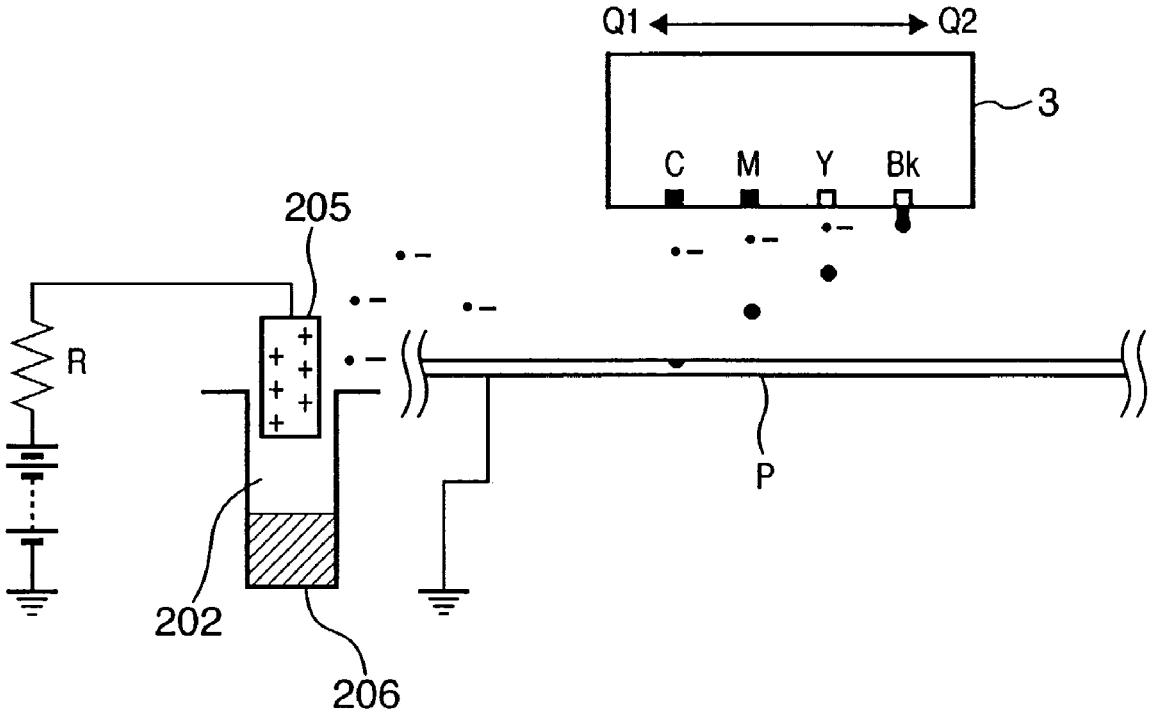
FIG. 2 is a view showing the configuration of an ink mist collecting unit 202 and collection of fine ink droplets.

FIG. 2 is a view showing the configuration of an ink mist collecting unit 202 and collection of fine ink droplets.

As shown in FIG. 2, the ink mist collecting unit 202 is made up of an electrode 205 and collecting vessel 206. Since the electrode 205 which is vertically arranged keeps a positive potential with respect to ground of the printing apparatus, negatively charged fine ink droplets (ink mist) are gathered to the electrode 205, drip to the collecting vessel 206, and are collected. The collecting vessel 206 has a spongy ink absorber. The printing apparatus has a suction pump (not shown) for cleaning and recovering the printhead, as described above. Thus, the ink absorber of the collecting vessel 206 can have a large total reception amount by communicating with a reservoir for waste ink which comes from the wiping mechanism 12 for cleaning.

Note that FIG. 1 shows the inside of the printing apparatus for descriptive convenience. In practical use, the printing apparatus is covered with an outer covering to form a substantially closed space against outside air of the printing apparatus. Hence, charged floating mist generated upon ink discharge is stirred in the whole interior of the printing apparatus by reciprocation of the carriage 2 holding the printhead 3. Accordingly, even ink mist generated at a portion apart from the ink mist collecting unit 202 floats around the ink mist collecting unit 202 soon or later upon the lapse of time, and is captured by the ink mist collecting unit 202.

Referring back to FIG. 1, reference numeral 210 denotes a charge removing brush connected to ground of the printing apparatus. When fed or conveyed, the printing medium P causes frictional electrification or peeling electrification, and may involuntarily adsorb charged floating mist in the apparatus. To prevent this, when the printing medium P is conveyed in the direction indicated by the arrow B and fed into the apparatus, the potential of the printing medium P is reduced to ±0 V by the charge removing brush 210 immediately before the printing medium P reaches the printing area of the printhead 3. This can prevent charged ink mist from attaching to and contaminating the printing medium P.

<Control Configuration of Inkjet Printing Apparatus (FIG. 3)>

Figure 3:
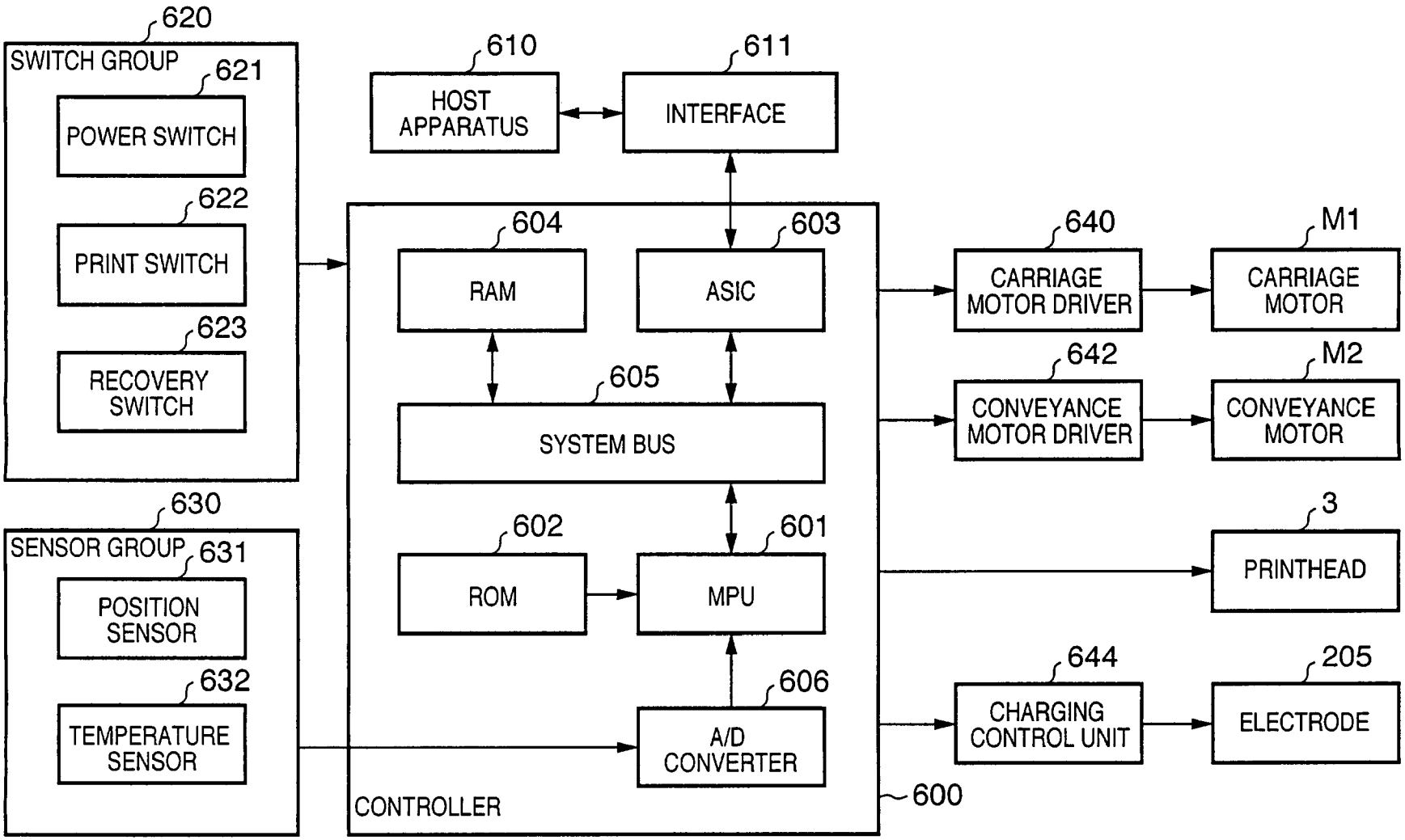
FIG. 3 is a block diagram showing the control configuration of the printing apparatus shown in FIG. 1.

FIG. 3 is a block diagram showing the control configuration of the printing apparatus shown in FIG. 1.

As shown in FIG. 3, a controller 600 comprises an MPU 601, ROM 602, ASIC (Application Specific Integrated Circuit) 603, RAM 604, system bus 605, and A/D converter 606. The ROM 602 stores a program corresponding to a control sequence (to be described later), a predetermined table, and other fixed data. The ASIC 603 generates control signals for controlling the carriage motor M1, conveyance motor M2, and printhead 3. The RAM 604 is used as an image data rasterizing area, a work area for executing a program, and the like. The system bus 605 connects the MPU 601, ASIC 603, and RAM 604 to each other, and allows exchanging data. The A/D converter 606 receives analog signals from a sensor group (to be described below), A/D-converts the analog signals, and supplies digital signals to the MPU 601.

In FIG. 3, reference numeral 610 denotes a computer (or an image reader, digital camera, or the like) which serves as an image data supply source and is generally called a host apparatus. The host apparatus 610 and printing apparatus 1 transmit/receive image data, commands, status signals, and the like via an interface (I/F) 611.

Reference numeral 620 denotes a switch group which is formed from a power switch 621, print switch 622, recovery switch 623, and the like. The print switch 622 is used for designating the start of printing. The recovery switch 623 is used for designating the activation of a process (recovery process) of maintaining good ink discharge performance of the printhead 3. These switches are formed from buttons for receiving instruction inputs from the operator.

Reference numeral 630 denotes a sensor group which detects the state of the apparatus and includes a position sensor 631 such as a photocoupler for detecting a home position and a temperature sensor 632 arranged at a proper portion of the printing apparatus in order to detect the ambient temperature.

Reference numeral 640 denotes a carriage motor driver which drives the carriage motor M1 for reciprocating the carriage 2 in the direction indicated by the arrow A; and 642, a conveyance motor driver which drives the conveyance motor M2 for conveying the printing medium P.

In printing and scanning by the printhead 3, the ASIC 603 transfers driving data (DATA) for a printing element (heater) to the printhead while directly accessing the storage area of the RAM 604.

An encoder signal from an encoder (not shown) attached to the carriage 2 is transferred to the MPU 601 of the controller 600 via a position detecting mechanism (not shown).

Reference numeral 644 denotes a charging control unit which controls application of a voltage to the electrode 205 of the ink mist collecting unit 202.

As described above, the ink cartridge 6 and printhead 3 may be configured to be separated from each other. Alternatively, the ink cartridge 6 and printhead 3 may be integrated into an exchangeable head cartridge IJC.

Figure 4:
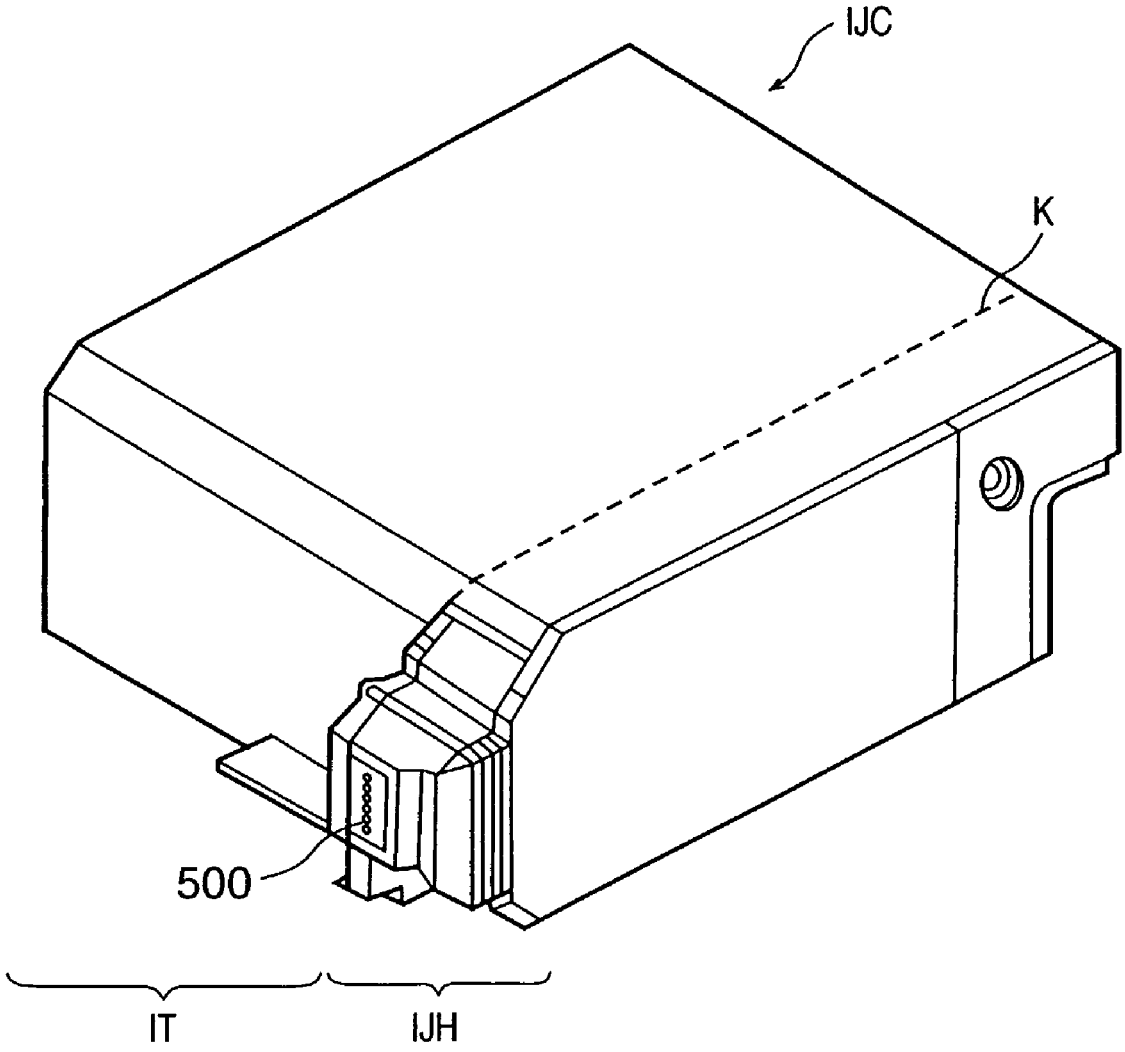
FIG. 4 is an outer perspective view showing the structure of a head cartridge integrating an ink tank and printhead.

FIG. 4 is an outer perspective view showing the structure of the head cartridge IJC integrating an ink tank and printhead. In FIG. 4, a broken line K is a boundary between an ink tank IT and a printhead IJH. The head cartridge IJC has an electrode (not shown) for receiving an electrical signal supplied from the carriage 2 when the head cartridge IJC is mounted on the carriage 2. This electrical signal drives the printhead IJH to discharge ink, as described above.

In FIG. 4, reference numeral 500 denotes an ink orifice array. The ink tank IT is equipped with a fibrous or porous ink absorber in order to hold ink.

Several embodiments of an ink mist collecting method and printing method performed by the printing apparatus having the above configuration will now be described.

First Embodiment

Most of ink droplets about 5 pl (picoliter) in volume discharged from a printhead 3 attach to a printing medium P and form an image. However, small satellites generated around the tail ends of ink droplets, and fine ink droplets bounded back from the printing medium P float in the apparatus. If such satellites and fine ink droplets are left to stand, they contaminate unlimited portions in the apparatus. Especially, satellites and fine ink droplets tend to deposit at electrostatically charged portions such as a sliding portion (e.g., guide shaft 13). There is known a phenomenon (Lenard effect) in which droplets tend to be charged either positively or negatively, especially negatively when an internally polarized droplet is broken into particles or droplets collide against each other in a process of forming (spraying) small droplets containing water.

For this reason, fine ink droplets (e.g., satellites) generated when ink droplets are discharged from the printhead 3 tend to be charged negatively.

As described with reference to FIG. 2, an electrode 205 of an ink mist collecting unit 202 has a positive potential, and most of fine ink droplets tend to travel toward the positively charged ink mist collecting unit 202. FIG. 2 conceptually shows the flow of ions and ink droplets from generation of charged mist to collection of mist.

Figure 5:
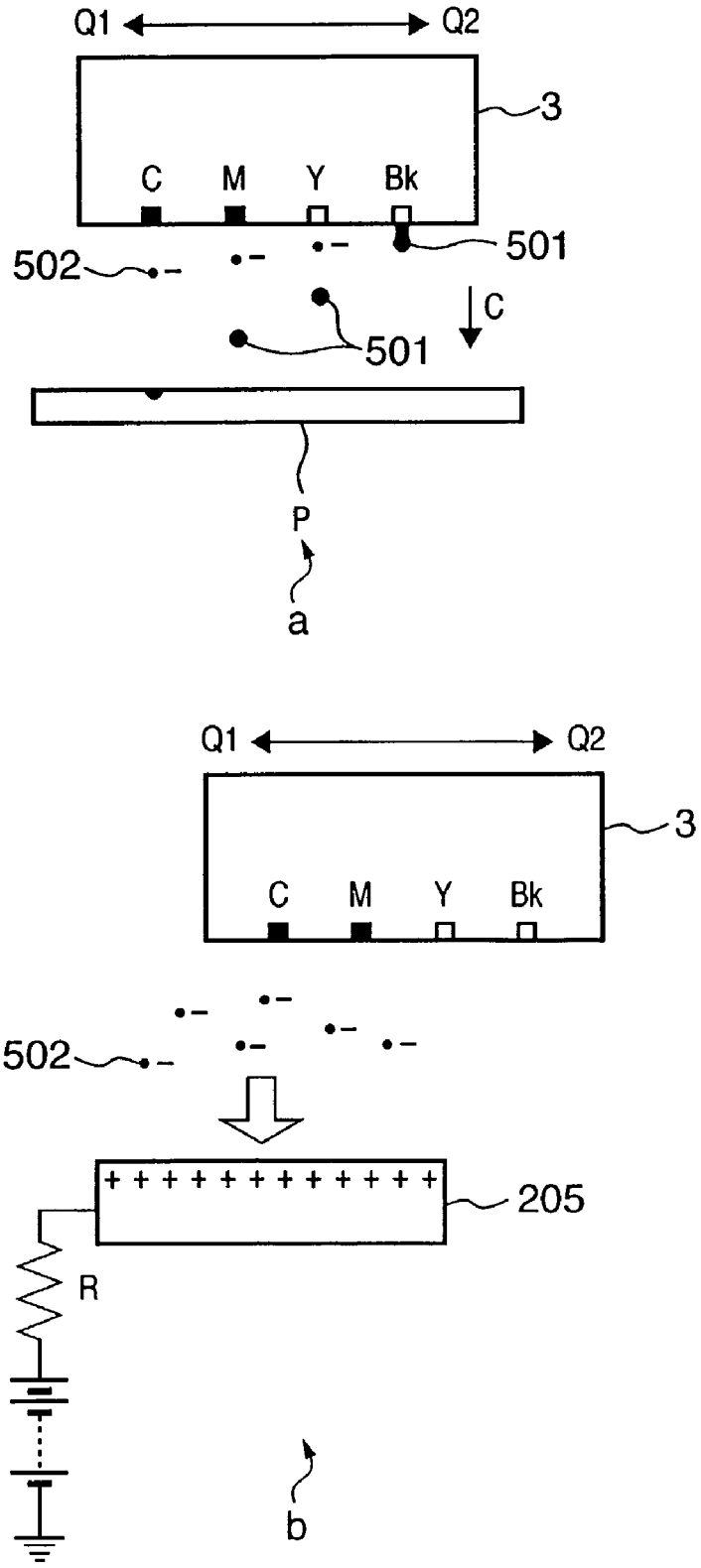
FIG. 5 is a view for explaining the behavior of fine ink droplets according to the first embodiment of the present invention.

FIG. 5 is a schematic view for explaining the behavior of fine ink droplets according to the first embodiment.

As represented in a of FIG. 5, C, M, Y, and Bk ink droplets 501 discharged from the printhead 3 and represented by black points travel toward the printing medium P in the direction indicated by the arrow C, and attach to the printing medium to form a character or image. Simultaneously when the ink droplets 501 are discharged, fine satellites 502 are also generated following the ink droplets 501 along the discharge direction. The fine satellites 502 are negatively charged and float as ink mist. In FIG. 5, the printhead 3 moves above the printing medium P in the left-and-right direction indicated by the arrows Q1 and Q2 in accordance with the illustration of FIG. 1.

A state is represented by b in FIG. 5 in which negatively charged ink mist is attracted by electrostatic force to the ink mist collecting unit 202 outside the printing area. Negatively charged fine ink droplets are attracted to the surface of the positively charged electrode 205, are accelerated, and travel.

Figure 6:
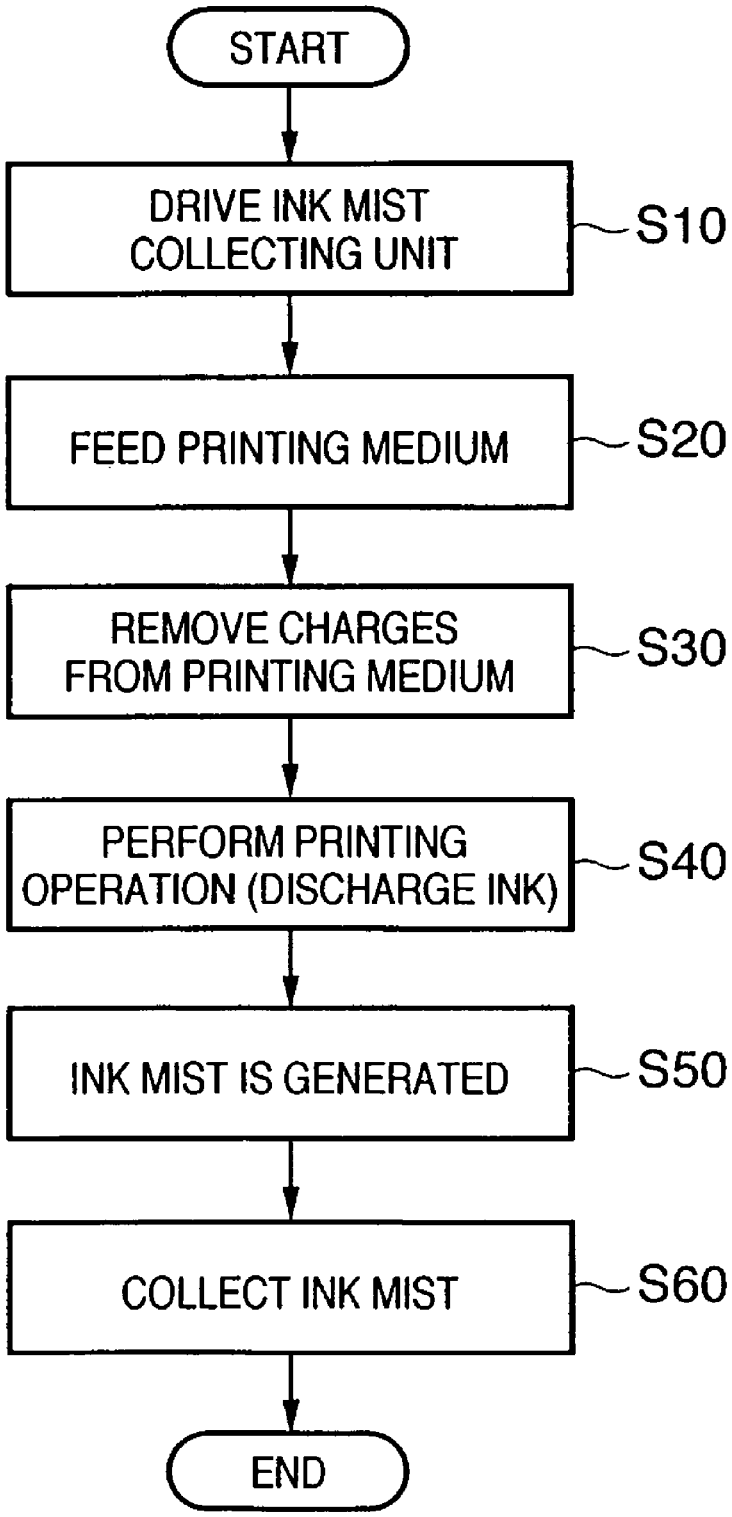
FIG. 6 is a flowchart showing an ink mist collecting method according to the first embodiment of the present invention.

The above-described method can be summarized into the flowchart shown in FIG. 6.

FIG. 6 is a flowchart showing a summary of the ink mist collecting method according to the first embodiment.

In step S10, the ion collecting unit is driven by applying a positive voltage to the electrode 205 of the ink mist collecting unit 202. In step S20, the printing medium P is fed and conveyed into the printing apparatus. At this time, in step S30, the charges of the printing medium are removed by a charge removing brush 210 immediately before the printing medium P enters the printing area.

In step S40, the printhead 3 is driven to discharge ink and print. At this time, in step S50, ink mist is generated upon discharge of ink droplets, and starts diffusing and floating in the apparatus.

In step S60, since ink mist is negatively charged, as described above, ink mist is collected by electrostatic force between ink mist and the positive voltage-applied electrode of the ink mist collecting unit.

As described above, according to the first embodiment, ink mist can be collected by electrostatic force generated between negatively charged ink mist and the positive voltage-applied electrode. As a result, the amount of fine ink mist floating in the printing apparatus decreases, and the interior of the printing apparatus is less contaminated by attached ink mist. For example, mist can be prevented from attaching to the movable portion of the carriage and degrading the movable characteristic. For example, mist can be prevented from attaching to the sensor unit and causing the sensor to malfunction. Further, for example, mist can be prevented from floating out from the printing apparatus, contaminating the exterior of the apparatus, and contaminating the next printing medium subjected to printing.

Particles collectable by the ink mist collecting unit include not only negatively charged ink mist but also shaving (dust) of a printing medium and dirt which externally enters the printing apparatus as far as they are electrically negatively charged.

Second Embodiment

For example, in a large-scale printing apparatus for commercial use or the like that prints on a printing medium as large as A0 or B0, it is difficult to efficiently collect ink mist in the entire apparatus by the ink mist collecting method which only depends on spontaneous diffusion of ink mist and electrostatic force, as described in the first embodiment, because the distance to the ink mist collecting unit is long.

Taking this into consideration, the second embodiment will explain a configuration in which ink mist floating in the apparatus is forcedly moved by an air current toward the ink mist collecting unit.

Figure 7:
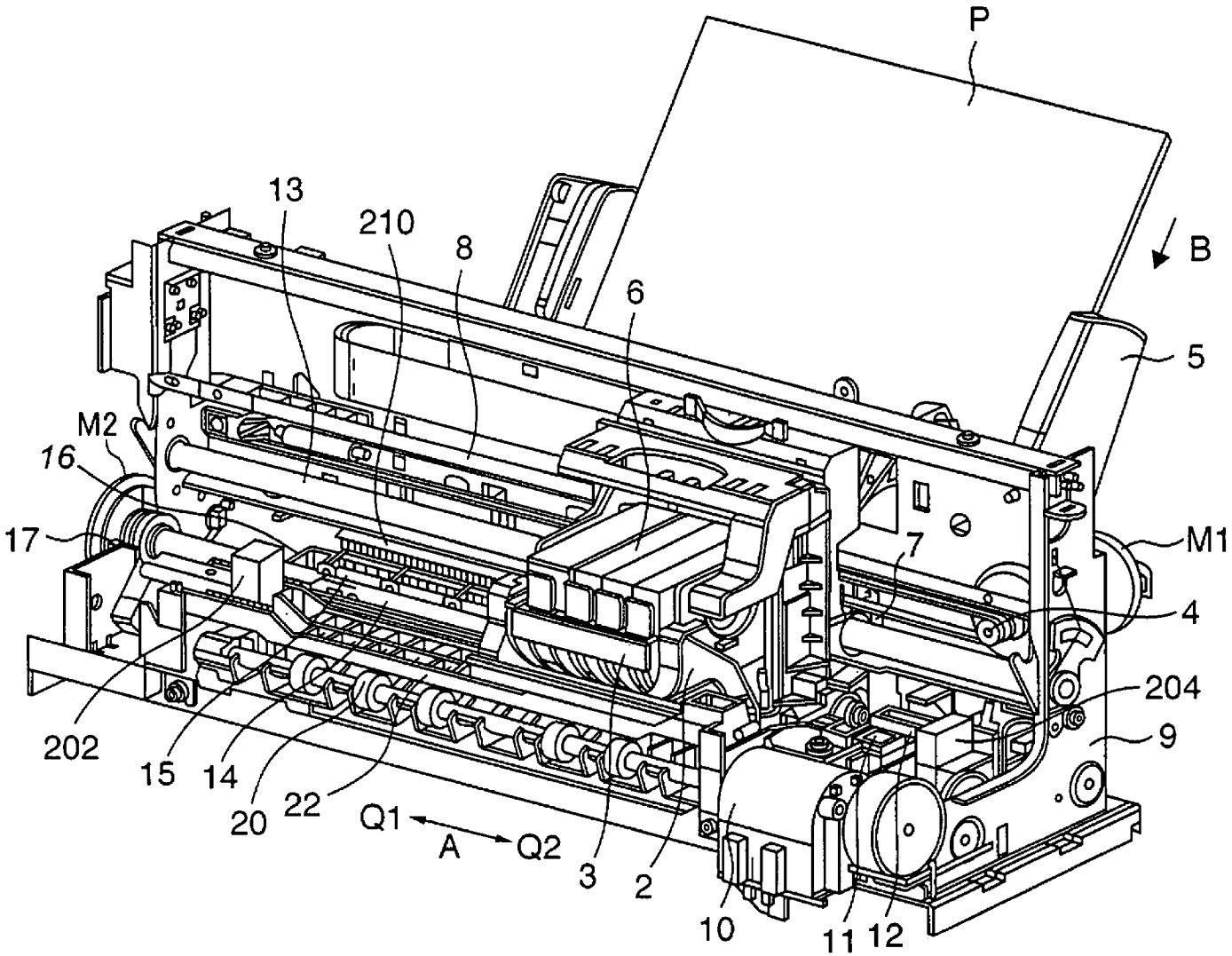
FIG. 7 is a perspective view showing the configuration of an inkjet printing apparatus according to the second embodiment of the present invention.

FIG. 7 is an outer perspective view showing the schematic configuration of a printing apparatus according to the second embodiment. As is apparent from a comparison between FIGS. 7 and 1, their configurations are almost the same. The same reference numerals denote the same parts, and a description thereof will be omitted.

A characteristic feature of the printing apparatus according to the second embodiment is that a fan 204 is arranged on a side opposite to an ink mist collecting unit 202 via the printing area of a printing medium P in the moving direction of the carriage.

Figure 8:
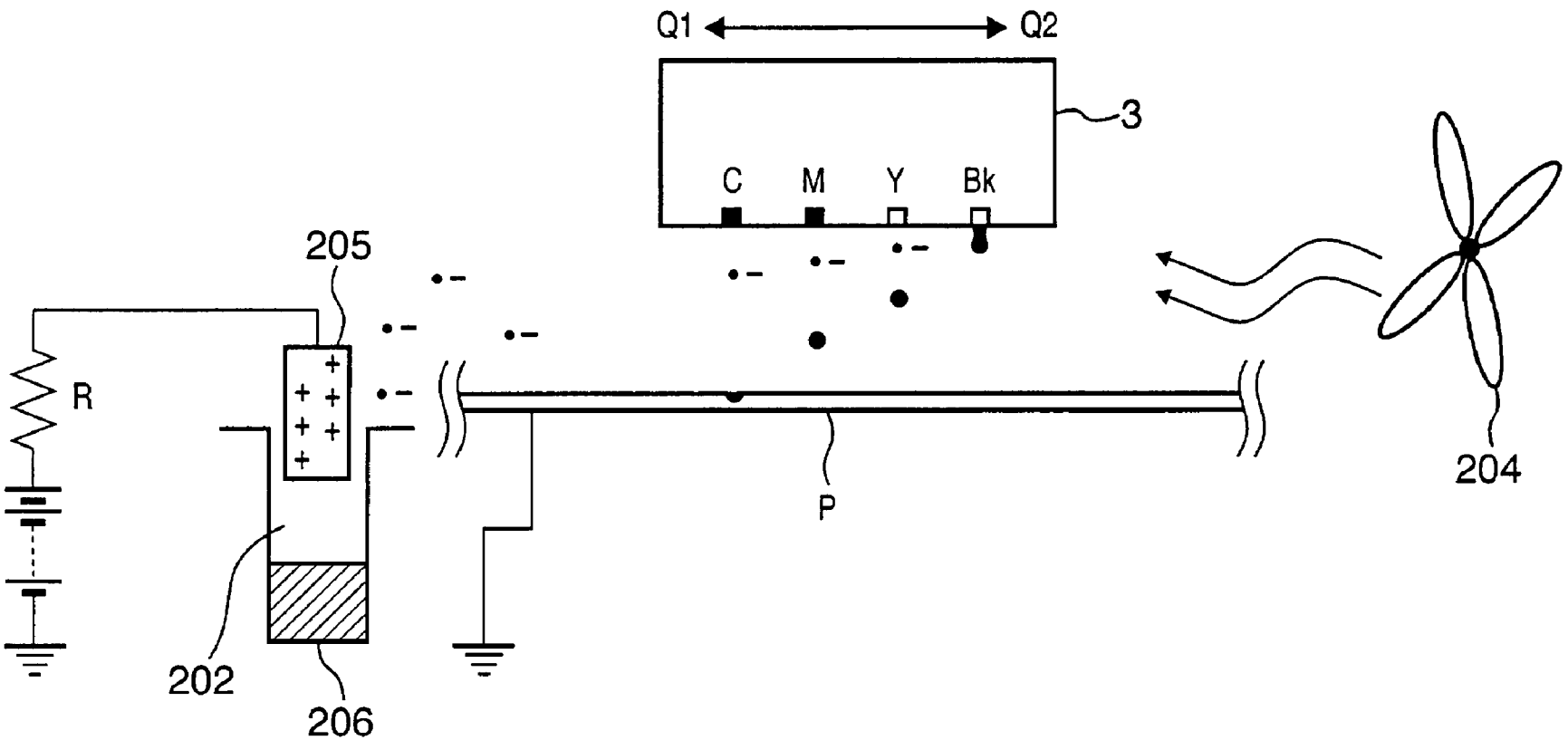
FIG. 8 is a view showing a configuration for collecting ink mist according to the second embodiment of the present invention.

FIG. 8 is a schematic view for explaining the behavior of fine ink droplets according to the second embodiment.

As shown in FIG. 8, in the second embodiment, ink mist floating in the scanning range of the printhead is forcedly moved by an air flow generated by the fan 204. Charged ink mist generated at an area apart from the ink mist collecting unit 202 can be moved close to the ink mist collecting unit 202.

Hence, ink mist can be efficiently collected even in the above-mentioned printing apparatus which has a wide printing area in the scanning direction of the printhead.

Note that the position where the fan is arranged is not limited to the configuration shown in FIG. 8. For example, the fan may be interposed between the ink mist collecting unit 202 and the area where the printhead prints, and create an air flow toward the ink mist collecting unit 202. With this configuration, ink mist floating in the area where printing is performed can be moved by an air flow to the ink mist collecting unit 202 and efficiently collected.

The fan described in the second embodiment can be obviously applied to a smaller-size printing apparatus. Particularly when a space where ink mist floats becomes complicated, as in a printing apparatus in which a printhead and ink tank are separated and ink is supplied via a tube, ink mist can be moved to the ink mist collecting unit without attaching ink mist to unintended positions.

Third Embodiment

Ink droplets discharged from the printhead generally travel straight and attach to a printing medium. However, if the printhead moves at a high speed, ink droplets may attach to unintended positions because of an air flow generated by the movement of the printhead or an air flow generated by ink droplets themselves which are successively discharged from the printhead. To solve this problem, a method of increasing the initial velocity of ink droplets to suppress the influence of the air resistance and air flow and increase the precision of attaching positions on a printing medium has conventionally been employed.

However, as schematically shown in a of FIG. 5 in connection with the first embodiment, ink mist (satellites) which is a problem in the present invention is generated by a phenomenon in which the shape of an ink droplet is deformed into a teardrop shape, and a tail part of the droplet is torn off upon ink discharge. It is, therefore, difficult to increase the initial velocity of satellites.

The third embodiment will describe an example in which satellites are moved toward a printing medium by using electrostatic force and accurately attached to the printing medium.

Figure 9:
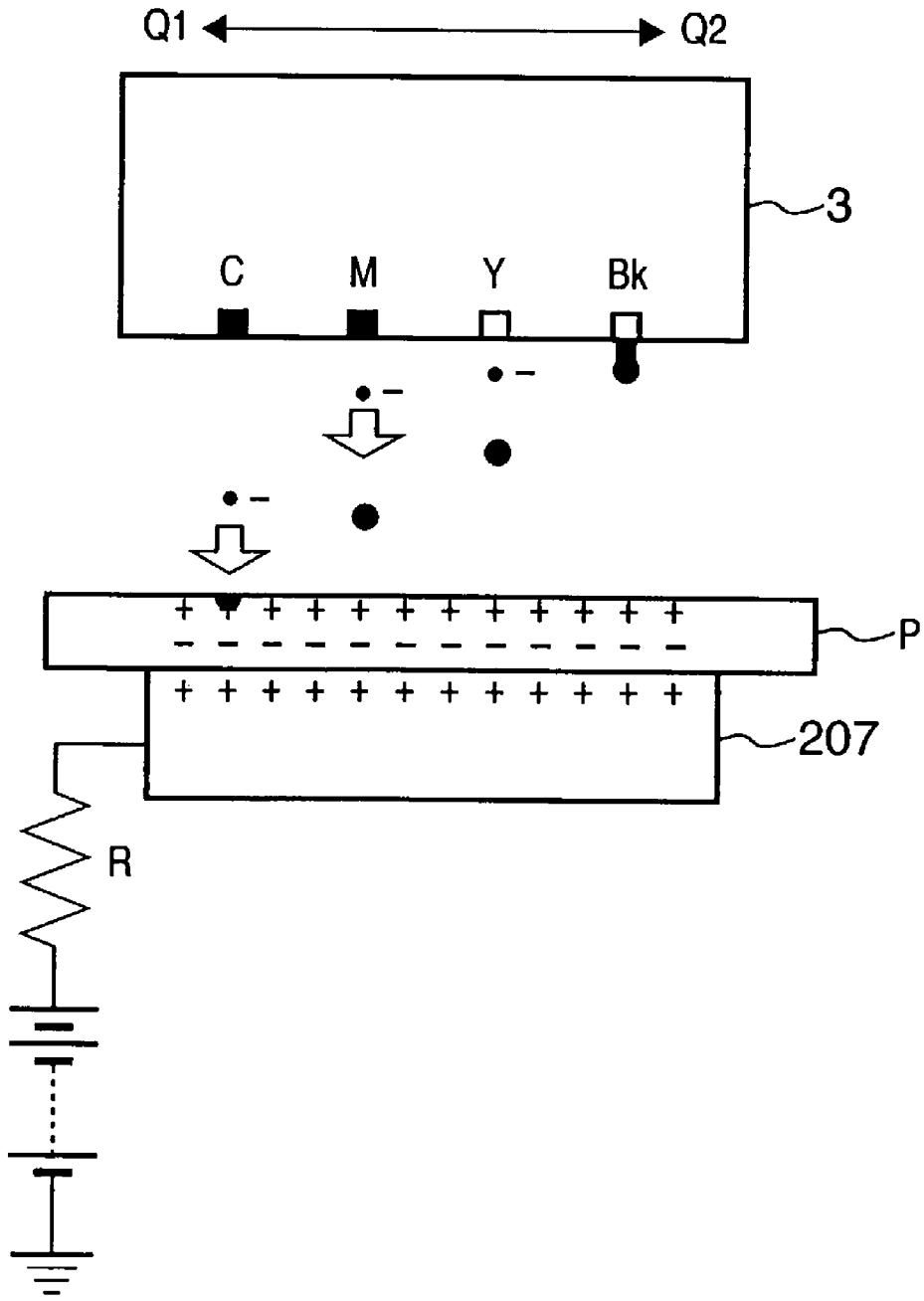
FIG. 9 is a view showing a configuration for guidance control of satellites according to the third embodiment of the present invention.

FIG. 9 is a schematic view for explaining control of the behavior of fine ink droplets (satellites).

As shown in FIG. 9, in the third embodiment, an electrode 207 similar to an ink mist collecting unit 202 is set on the lower surface of a printing medium P. In general, the printing medium P is a dielectric material, and its surface opposite to a printhead 3 is positively biased when the electrode 207 is positively charged.

As described above, satellites serving as fine ink droplets tend to be charged negatively. Satellites are attracted to the surface of the printing medium P by positive potential generated on the surface of the printing medium P, and can reach the printing medium P even under the influence of an air flow or the like.

According to the third embodiment, even satellites which are low in initial velocity and poor in the precision of attaching positions on a printing medium can be accurately attached to a printing medium by using electrostatic force.

Consequently, satellites can be prevented from accidentally attaching to unintended portions on a printing medium to degrade the printing quality or contaminating the printing medium. This contributes to improvement of the printing quality.

Fourth Embodiment

The third embodiment assumes a case where the distance between the printing medium P and the printhead 3 is long enough and no electric field is generated between the ink discharge surface of the printhead and the printing medium. However, in a printing apparatus which utilizes fine ink droplets of 1 pl or less in volume, evaporation in the air must be taken into consideration in order to attach ink droplets to a printing medium at high precision. For this purpose, the ink discharge surface and printing medium must be brought extremely close to each other.

Figure 10:
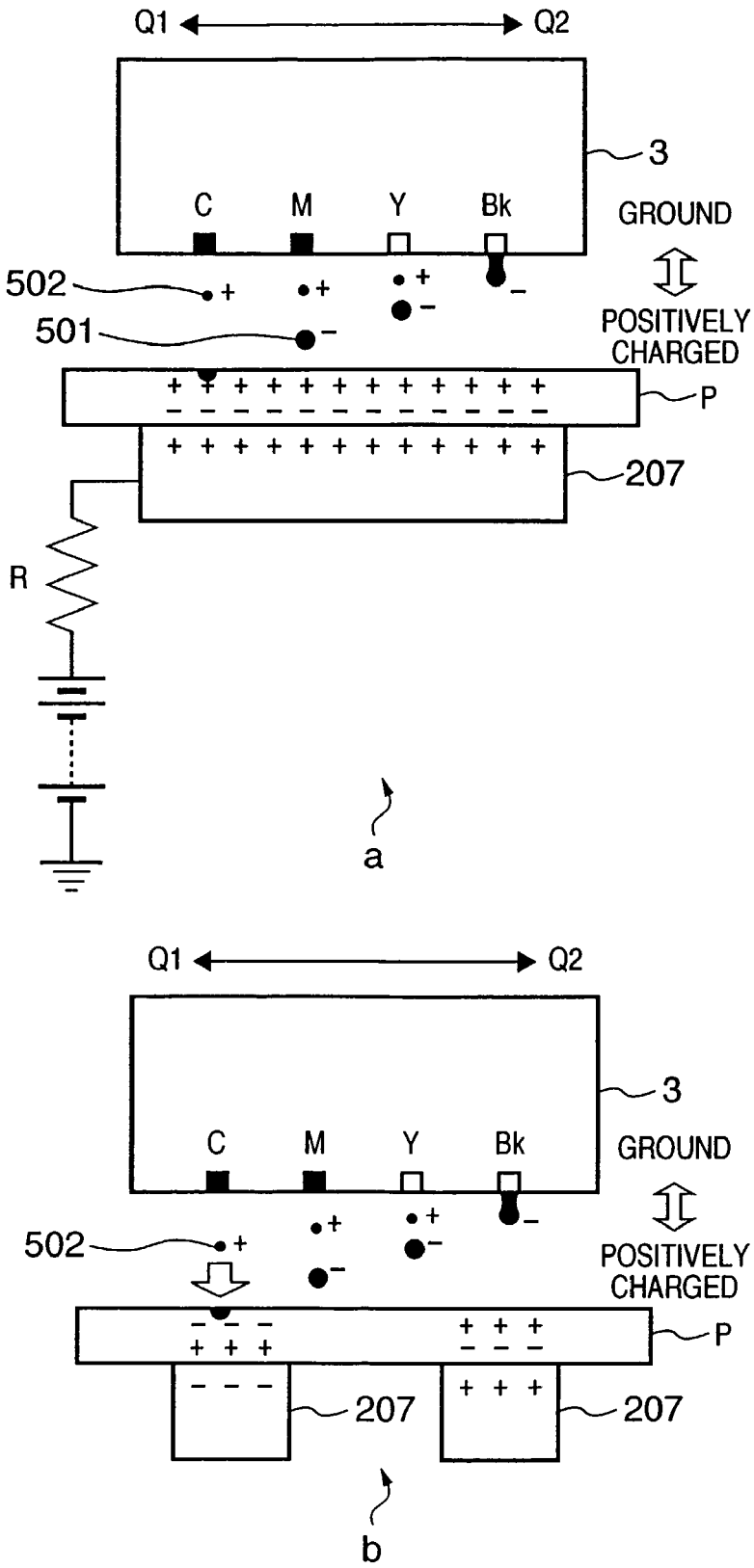
FIG. 10 is a view showing a configuration for guidance control of satellites according to the fourth embodiment of the present invention.

FIG. 10 is a schematic view for explaining control of the behavior of fine ink droplets (satellites) in a case where the distance between the printhead and a printing medium is short.

Formation of ink droplets is represented by a in FIG. 10 in a case where an electrode 207 and printhead 3 are brought extremely close to each other.

At a short distance between the printhead and a printing medium, if an electrode is set below a printing medium so that a surface of the printing medium P that faces the printhead is positively biased, the ink discharge surface of the printhead is negatively biased by electrostatic induction, thus creating an electric field in the space between the printhead and the printing medium P.

In this environment, ink is dielectrically polarized by the electric field between the printhead and a printing medium in the initial stage of ink droplet formation. As a result, a main ink droplet 501 is negatively charged, and its tail part (which changes into a satellite mist 502 soon or later) is positively charged. In this state, satellite mist is repulsed by the positively biased surface of the printing medium P, and the image quality is most likely to degrade.

Taking this situation into consideration, according to the fourth embodiment, the polarity of the electrode 207 is controlled to be reversed at a timing corresponding to the movement of satellite mist so as to assist attachment of positively charged satellite mist, as represented in b of FIG. 10. In other words, the polarity reversal timing of the electrode 207 is synchronized with the ink discharge timing of the printhead 3.

According to the above-described embodiment, high-resolution printing can be achieved by accurately attaching fine ink droplets of 1 pl or less in volume to a printing medium and also attaching, to desired positions, satellite mist of an electrically opposite polarity which is generated together with main droplet formation.

Fifth Embodiment

The fifth embodiment will explain an example in which a groove-shaped ink receptor is arranged in the moving direction of the printhead in a platen which holds a printing medium in opposition to the printhead when printing is performed on the entire area of a printing medium P (marginless printing).

Figure 11:
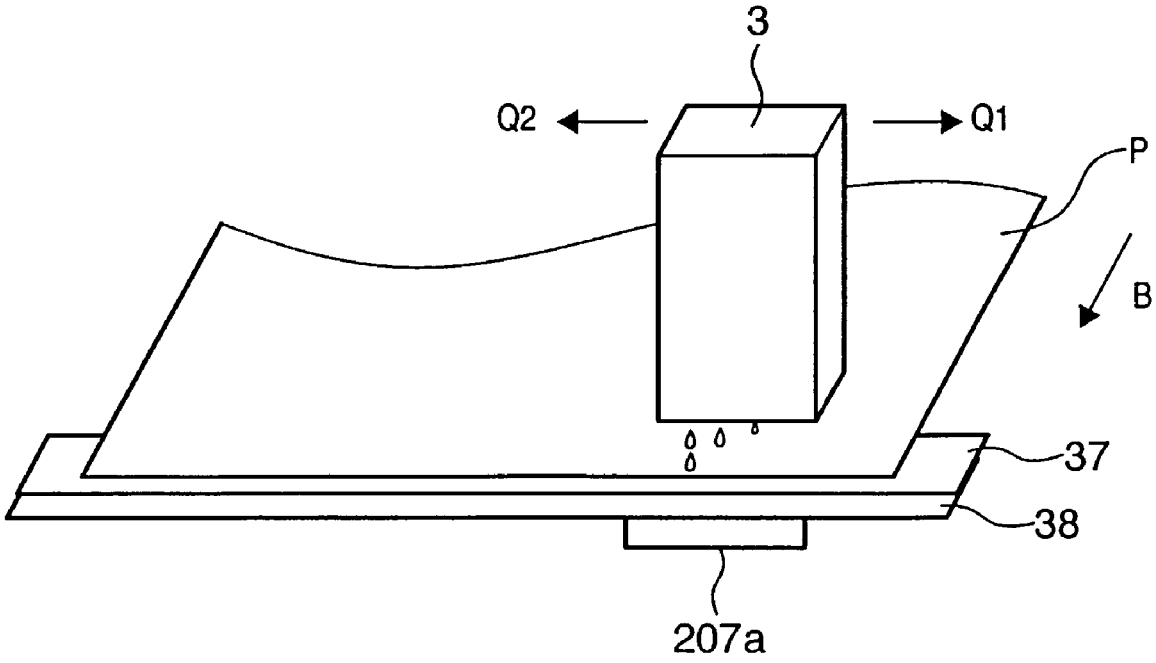
FIG. 11 is a view showing a configuration for collecting ink mist according to the fifth embodiment of the present invention.

FIG. 11 is a schematic view showing a configuration near the printhead and platen of a printing apparatus which performs marginless printing.

In FIG. 11, reference numeral 37 denotes a platen; 38, an ink absorber which is disposed in the ink receptor; and 207*a*, an electrode which is arranged below the ink absorber 38. This configuration can electrify the ink absorber.

In the first to fourth embodiments, as shown in FIGS. 1 and 7, the ink mist collecting unit 202 is arranged at an end in the moving direction of the printhead. In the fifth embodiment, the ink absorber 38 which absorbs ink discharged outside a printing medium along with marginless printing is further electrified to effectively collect ink mist.

Of inkjet printing methods, the above embodiments employs a method which uses a means (e.g., electrothermal transducer) for generating thermal energy as energy used to discharge ink and changes the ink state by thermal energy. The present invention can also be applied to a method which generates energy to discharge ink by using a piezoelectric element instead of the electrothermal transducer.

In the above embodiments, droplets discharged from the printhead are ink, and a liquid contained in the ink tank is ink. The content of the ink tank is not limited to ink. For example, the ink tank may contain a processing liquid which is discharged onto a printing medium in order to increase the fixing properties, water repellency, or quality of a printed image.

In addition, the present invention is also effective when the serial scan type inkjet printing apparatus as described in the above embodiments uses a printhead which is fixed to the apparatus body, or an exchangeable cartridge type printhead which can be electrically connected to the apparatus body and receive ink from the apparatus body when attached to the apparatus body.

Further, the present invention can be applied to a full line type printhead having a printing width corresponding to the width of a printing medium.

Moreover, the inkjet printing apparatus according to the present invention may take the form of an image output apparatus for an information processing device such as a computer. The inkjet printing apparatus may also take the form of a copying machine combined with a reader, or a facsimile apparatus having a transmission/reception function.

As many apparently widely different embodiments of the present invention can be made without departing from the spirit and scope thereof, it is to be understood that the invention is not limited to the specific embodiments thereof except as defined in the appended claims.

This application claims the benefit of Japanese Application No. 2004-371883, filed on Dec. 22, 2004, which is hereby incorporated by reference herein in its entirety.

The invention claimed is:

1. A printing apparatus which prints by discharging an ink droplet from a printhead onto a printing medium, comprising:

scanning means for scanning the printhead across a scanning range;

charge removing means for removing charges from the printing medium before printing;

printing means for printing by discharging ink from the printhead onto the printing medium;

collecting means for collecting, by electrostatic force and an air flow, ink mist which is discharged from the printhead for printing by said printing means and floats without being used for printing, wherein said collecting means is arranged near one end of the scanning range of the printhead by said scanning means; and air flow generation means for generating the air flow towards said collecting means, wherein said air flow generation means is arranged near the other end of the scanning range.

2. The apparatus according to claim 1, wherein said collecting means comprises:

a first electrode having a polarity opposite to a polarity of the ink mist; and a reservoir unit which stores ink from ink mist collected by said first electrode and contains an absorber.

3. The apparatus according to claim 1, wherein said air flow generation means comprises a fan which moves the ink mist toward said collecting means.

4. The apparatus according to claim 2, further comprising a second electrode provided on a side on which said second electrode faces an ink discharge surface of the printhead via the printing medium in the printing area for the printing medium by the printhead, wherein a surface of the printing medium that faces the ink discharge surface of the printhead is electrified by applying a voltage to said second electrode.

5. The apparatus according to claim 1, wherein the ink mist is negatively charged.

6. The apparatus according to claim 4, wherein a positive voltage is applied to said first electrode and said second electrode.

7. The apparatus according to claim 1, further comprising:

a platen which supports the printing medium along a scanning direction of said scanning means; and an ink absorber which absorbs ink discharged from the printhead along said platen.

8. The apparatus according to claim 7, wherein said ink absorber has an electrode which attracts the ink mist by electrostatic force.

9. The apparatus according to claim 4, wherein, in a case where a distance between the ink discharge surface of the printhead and the printing medium is short and an electric field is generated, a polarity of said second electrode is controlled in synchronism with movement of the printhead and an ink discharge cycle, and is reversed in accordance with a positional relationship with an ink discharge nozzle of the printhead.

10. An ink mist collecting method for a printing apparatus which prints by discharging an ink droplet from a printhead onto a printing medium, comprising:

a charge removing step of removing charges from the printing medium before printing;

a printing step of printing by scanning the printhead across a scanning range while discharging ink from the printhead onto the printing medium from which charges have been removed at said charge removing step; and a generating step of artificially generating an airflow from a first end of the scanning range to a second end thereof; and a collecting step of collecting, by electrostatic force and the artificially generated air flow, ink mist which is discharged from the printhead for printing at said printing step, and floats without being used for printing, wherein the ink mist is collected at the second end of the scanning range.

* * * * *